US010573251B2

(12) United States Patent
Chen

(10) Patent No.: US 10,573,251 B2
(45) Date of Patent: Feb. 25, 2020

(54) LIQUID CRYSTAL DISPLAY DEVICE AND METHOD FOR DRIVING THE SAME

(71) Applicants: HKC CORPORATION LIMITED, Shenzhen (CN); CHONGQING HKC OPTOELECTRONICS TECHNOLOGY CO., LTD., Chongqing (CN)

(72) Inventor: Yujen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 141 days.

(21) Appl. No.: 15/744,042

(22) PCT Filed: Mar. 14, 2017

(86) PCT No.: PCT/CN2017/076592
§ 371 (c)(1),
(2) Date: Jan. 11, 2018

(87) PCT Pub. No.: WO2018/120435
PCT Pub. Date: Jul. 5, 2018

(65) Prior Publication Data

US 2019/0005896 A1 Jan. 3, 2019

(30) Foreign Application Priority Data

Dec. 27, 2016 (CN) ..... 2016 1 1229080

(51) Int. Cl.
*G09G 5/10* (2006.01)
*G09G 3/34* (2006.01)
(Continued)

(52) U.S. Cl.
CPC ..... *G09G 3/3413* (2013.01); *G09G 3/2018* (2013.01); *G09G 3/3406* (2013.01);
(Continued)

(58) Field of Classification Search
CPC ..... G09G 5/10; G09G 3/2007
(Continued)

(56) References Cited

U.S. PATENT DOCUMENTS

2008/0117162 A1 5/2008 Song et al.
2012/0182332 A1* 7/2012 Liu ..... G09G 3/2007 345/691
2013/0321483 A1* 12/2013 You ..... G09G 5/10 345/690

FOREIGN PATENT DOCUMENTS

CN 101866636 A 10/2010
CN 102138098 A 7/2011
(Continued)

OTHER PUBLICATIONS

Office Action of the corresponding Chinese patent application issued by SIPO dated Aug. 1, 2017.

*Primary Examiner* — Abdul-Samad A Adediran
(74) *Attorney, Agent, or Firm* — Platinum Intellectual Property LLP

(57) ABSTRACT

A method for driving an LCD device includes: (S110) displaying each picture with two frame images, wherein the two frame images comprise a first frame image and a second frame image; wherein a driving voltage for each sub-pixel in the first frame image is greater than a driving voltage for a corresponding sub-pixel in the second frame image; (S120) determining a backlight brightness compensation signal according to the driving voltages of the first frame image and the second frame image; and (S130) compensating the backlight brightness of a next picture according to the backlight brightness compensation signal, such that the
(Continued)

backlight brightness of the first frame image of the next picture is less than a reference backlight brightness and the backlight brightness of the second frame image is greater than the reference backlight brightness.

18 Claims, 4 Drawing Sheets

(51) Int. Cl.
*G09G 3/20* (2006.01)
*G09G 3/36* (2006.01)

(52) U.S. Cl.
CPC ..... *G09G 3/36* (2013.01); *G09G 3/3607* (2013.01); *G09G 3/3696* (2013.01); *G09G 5/10* (2013.01); *G09G 2320/028* (2013.01); *G09G 2320/0242* (2013.01); *G09G 2320/0626* (2013.01); *G09G 2320/0646* (2013.01); *G09G 2340/0435* (2013.01)

(58) Field of Classification Search
USPC ..... 345/690, 691
See application file for complete search history.

(56) References Cited

FOREIGN PATENT DOCUMENTS

| | | | |
|---|---|---|---|
| CN | 103943080 | A | 7/2014 |
| CN | 104376828 | A | 2/2015 |
| CN | 105208365 | A | 12/2015 |
| CN | 105355181 | A | 2/2016 |
| CN | 105355182 | A | 2/2016 |
| JP | H0566501 | A | 3/1993 |

* cited by examiner

LIQUID CRYSTAL DISPLAY DEVICE AND METHOD FOR DRIVING THE SAME

CROSS REFERENCE TO RELATED APPLICATION

This application claims priority to Chinese Patent Application No. 201611229080.3, entitled "LIQUID CRYSTAL DISPLAY DEVICE AND METHOD FOR DRIVING THE SAME" filed on Dec. 27, 2016, the contents of which is expressly incorporated by reference herein in its entirety.

FIELD OF THE INVENTION

The present disclosure relates to liquid crystal display (LCD) technology field, and particularly relates to an LCD device and a method for driving the same.

BACKGROUND OF THE INVENTION

Most conventional large size liquid crystal displays adopt negative Vertical Alignment (VA) liquid crystal display or In-plane Switching (IPS) liquid crystal display technology. As to the driving of a VA liquid crystal display, in a large viewing angle, the brightness is rapidly saturated with the driving voltage, such that the viewing angle color shift is serious and the quality of the image is affected.

SUMMARY OF THE INVENTION

According to various embodiments of the present disclosure, an LCD device and a method for driving the same are provided, which can address the deficiency of viewing angle color cast.

A method for driving an LCD device includes:

displaying each picture with two frame images, wherein the two frame images include a first frame image and a second frame image; a driving voltage for each sub-pixel in the first frame image is greater than a driving voltage for a corresponding sub-pixel in the second frame image;

determining a backlight brightness compensation signal according to the driving voltages of the first frame image and the second frame image; and performing a backlight bright ness compensation of a next picture according to the backlight brightness compensation signal, such that a backlight brightness of the first frame image of the next picture is less than a reference backlight brightness and the backlight brightness of the second frame image of the next picture is greater than the reference backlight brightness.

An LCD device includes:

a display element;

a backlight element configured to provide backlight for the display element;

a driving element, connected to the display element configured to display each picture with two frame images; wherein the two frame images include a first frame image and a second frame image; a driving voltage for each sub-pixel in the first frame image is greater than a driving voltage for a corresponding sub-pixel in the second frame image;

a backlight compensation control element, connected to the backlight element configured to determine a backlight brightness compensation signal according to the driving voltages of the first frame image and the second frame image and, performing a backlight brightness compensation for a next picture according to the backlight brightness compensation signal, such that a backlight brightness of the first frame image of the next picture is less than a reference backlight brightness, and the backlight brightness of the second frame image of the next picture is greater than the reference backlight brightness.

An LCD device includes a display element;

a backlight element configured to provide backlight for the display element;

a driving element, connected to the display element configured to display each picture with two frame images; wherein the two frame images include a first frame image and a second frame image; a driving voltage for each sub-pixel in the first frame image is greater than a driving voltage for a corresponding sub-pixel in the second frame image;

a backlight compensation control element, connected to the backlight element configured to determine a backlight brightness compensation signal according to the driving voltages of the first frame image and the second frame image and, according to the backlight brightness compensation signal, compensate the backlight brightness of a next picture, such that the backlight brightness of the first frame image of the next picture is less than a reference backlight brightness and the backlight brightness of the second frame image is greater than the reference backlight brightness;

wherein the backlight compensation control element includes a memory and at least one processor; the memory is pre-storing a computer executable instruction that is executable by the at least one memory, when the computer executable instruction is executed by the at least one processor such that the steps in the following units are executed:

a statistic unit configured to calculate the maximum signal and the minimum signal of the target color sub-pixel in the input signal of each picture;

an acquiring unit configured to acquire a driving voltage of the first frame image and a driving voltage of the second frame image corresponding to the maximum signal according to the maximum signal, and to designate the driving voltage of the first frame image as a first driving voltage and the driving voltage of the second frame image as a second driving voltage;

wherein the acquiring unit is further configured to acquire a driving voltage of the first frame image and a driving voltage of the second frame image corresponding to the minimum signal according to the minimum signal, and to designate the driving voltage of the first frame image as a third driving voltage and the driving voltage of the second frame image as a fourth driving voltage; and a computing unit configured to calculate the backlight brightness compensation signal according to the first driving voltage, the second driving voltage, the third driving voltage, the fourth driving voltage and the reference backlight brightness signal;

wherein, in calculating the backlight brightness compensation signal according to the first driving voltage, the second driving voltage, the third driving voltage, the fourth driving voltage and the reference backlight brightness signal, a calculation formula is as follows:

$$L_L<L<L_H;$$

$$P_{TH}\times L+P_{TL}\times L=P_{TH}\times L_L+P_{TL}\times L_H;$$

$$P'_{TH}\times L+P'_{TL}\times L=P'_{TH}\times L_L+P'_{TL}\times L_H;$$

wherein, $L_L$ is the backlight brightness compensation signal to perform backlight compensation for the first frame image of the next picture; $L_H$ is the backlight brightness compensation signal to perform backlight compensation for the second frame image of the next picture; $P_{TH}$ is the first driving voltage; $P_{TL}$ is the second driving voltage; $P'_{TH}$ is the third driving voltage; $P'_{TL}$ is the fourth driving voltage; L is the reference backlight brightness signal, P is the target color sub-pixel.

According to the foregoing LCD device and the method for driving the same, by displaying each picture with two frame images, the driving voltages of corresponding sub-pixels in the two frame images are different; the backlight brightness compensation signal is determined in accordance with the driving voltages and reference backlight brightness signals of the two frame images, thereby compensating the backlight brightness of the next picture, such that the backlight brightness of the first frame image of the next picture is less than the reference backlight brightness and the backlight brightness of the second frame image is greater than the reference backlight brightness, thereby reducing the blinking due to the voltage switching difference of two frame images and effectively improve the color shift problem of the LCD device due to a mismatching of refractive index in a large viewing angle.

BRIEF DESCRIPTION OF THE DRAWINGS

The above objects, features and advantages of the present disclosure will become more apparent by describing in detail embodiments thereof with reference to the accompanying drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

The present disclosure will be described in the following with reference to the accompanying drawings and the embodiments in order to make the above objects, features and advantages of the present disclosure become more apparent, the specific embodiments will be described in detail in combination with the accompanying drawings. Numerous specific details are described hereinafter in order to facilitate a thorough understanding of the present disclosure. The various embodiments of the disclosure may, however, be embodied in many different forms and should not be construed as limited to the specific embodiments set forth hereinafter, and people skilled in the art can make similar modifications without departing from the spirit of the present disclosure.

Figure 1:
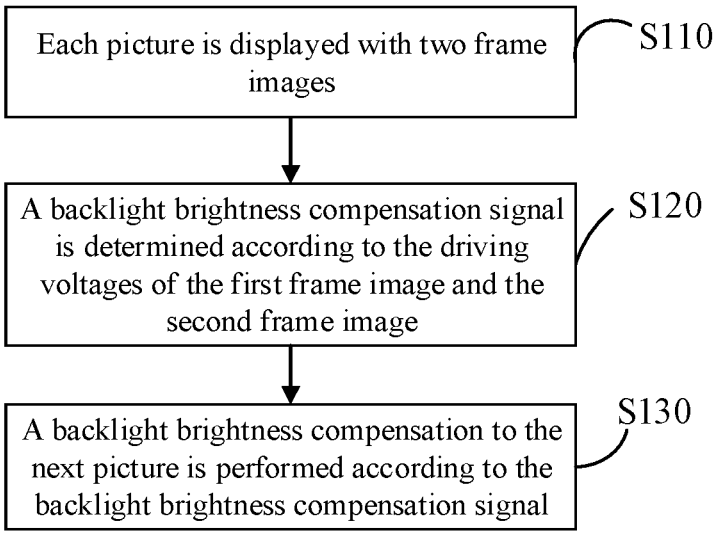
FIG. 1 is a flowchart of a method for driving an LCD device according to an embodiment.

FIG. 1 is a flowchart of a method for driving of an LCD device in an embodiment, the LCD device can be a Twisted Nematic (TN) display panel, an Optically Compensated Bend (OCB) display panel, an Vertical Alignment (VA) display panel, a Thin Film Transistor (TFT) display panel or a Color Filter on Array (COA) display panel display device, but not limited thereto. The backlight of the LCD may apply straight down or side backlight, the backlight source can be white, RGB three color light source, WRGB four color light source or RGBY four color light source, but not limited thereto. The driving method is also applicable in a scenario that the display panel of an LCD device is a curved panel.

Referring to FIG. 1, the method includes the following steps:

In step S110, each picture is displayed with two frame images.

Each picture (i.e., the conventional one frame image) is displayed with two frame images, i.e., a picture is divided into two frame images in timing sequence. The two frame images are a first frame image and a second frame image, respectively. Through a mutual compensation between the first frame image and the second frame image, an picture corresponding to the input signal is displayed for a user. In the present embodiment, a driving voltage for each sub-pixel in the first frame image is greater than a driving voltage for a corresponding sub-pixel in the second frame image. In other words, the first frame image is drove by a high driving voltage, and the second frame image is drove by a low driving voltage comparatively lower than that of the first frame image. The driving voltages for each sub-pixel in the first frame image and the second frame image can be acquired by looking up in a Look-up Table (LUT) and in accordance with input signals. In particular, in the LCD device, the LUT will be pre-stored in the hardware frame buffer beforehand. The LUT is a correspondence table on the picture input signals and the driving voltages for each sub-pixel in the first frame image and the second frame image which are corresponding to the input signals. In the case of a driving signal of 8 bit, corresponding to each R/G/B input signal input color gray scale value 0-255, there are 256 pairs of high and low voltage signals $R_{TH}/G_{TH}/B_{TH}$, and 3*256 pairs of high and low voltage signals $R_{TL}/G_{TL}/B_{TL}$ in total. Therefore, according to the gray scale value of each sub-pixel in the input signal, corresponding high driving voltage and corresponding low driving voltage can be found, thereby providing the high driving voltage as the driving voltage for the sub-pixel in the first frame image and the low driving voltage as the driving voltage for the sub-pixel in the second frame image.

In step S120, a backlight brightness compensation signal is determined according to the driving voltages of the first frame image and the second frame image.

Figure 2:
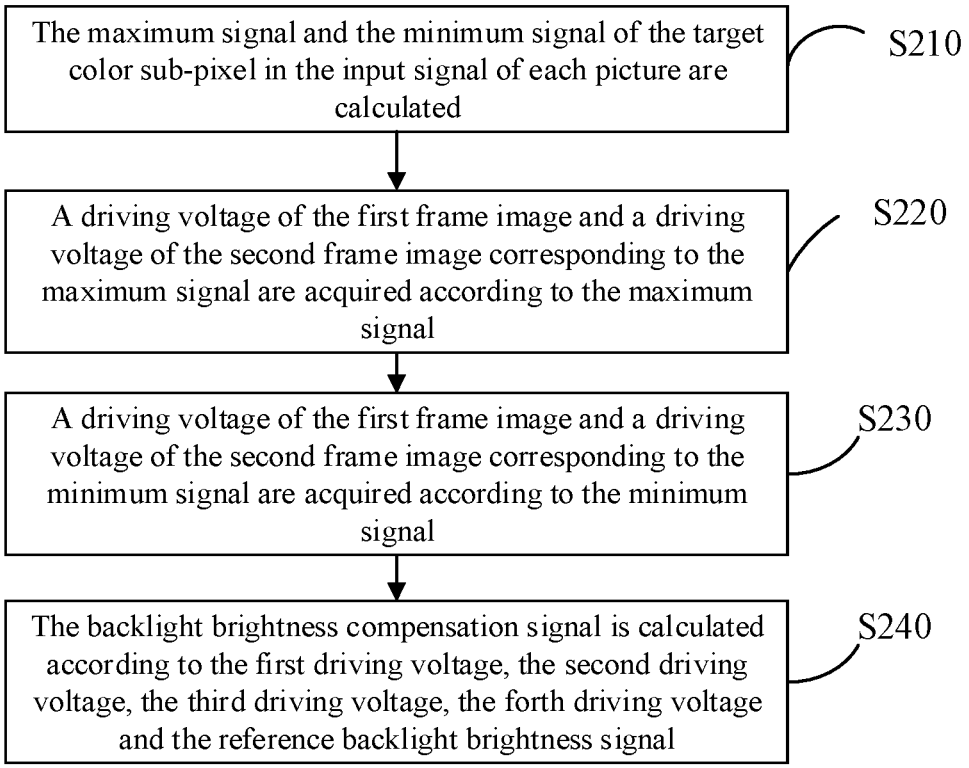
FIG. 2 is a flowchart of the S120 in FIG. 1.

The backlight brightness compensation signal is configured for backlight compensation for the backlight brightness of the two frame images of the next picture to reduce the viewing angle color cast. In the present embodiment, the process to determine the backlight brightness compensation signal is illustrated in FIG. 2, which includes the following steps:

In step S210, the maximum signal and the minimum signal of the target color sub-pixel in the input signal of each picture are calculated.

The target color sub-pixel can be a green sub-pixel, a red sub-pixel or a blue sub-pixel or any two colors therein, or the three colors simultaneously as the target color sub-pixel. In the case the backlight of the LCD is a white backlight source, the target color sub-pixel can be a green sub-pixel, a red sub-pixel or a blue sub-pixel. Preferably, in the case the backlight of the LCD is a white backlight source, the target color sub-pixel is selected to be a green sub-pixel. Compared to red and blue, green is relatively notable and whose blinking is relatively keen to naked eyes. Therefore, with the driving voltage for the green sub-pixel, the backlight brightness compensation signal for the different color sub-pixels in the next picture is determined, thereby satisfying the need of reducing the viewing angle color cast. In the case the backlight of the LCD is of RGB three color backlight source, the target color sub-pixel includes, at the same time, the green sub-pixel, the red sub-pixel and the blue sub-pixel, so as to calculate the backlight brightness compensation signal for different color sub-pixels. In the case the backlight of the LCD is of other backlight structure such as WRGB, the target color sub-pixel can be adjusted according to the backlight source structure. The maximum signal (or minimum signal) for target color sub-pixel can be the greatest color gray scale value of the target color (or the minimum color gray scale value).

In step S220, a driving voltage of the first frame image and a driving voltage of the second frame image corresponding to the maximum signal are acquired according to the maximum signal.

According to the maximum signal and through the LUT, the driving voltage of the first image and the driving voltage for the second image are acquired and are respectively denoted as the first driving voltage $P_{TH}$ and the second driving voltage $P_{TL}$. S220 can be carried out after the maximum signal is acquired.

In step S230, a driving voltage of the first frame image and a driving voltage of the second frame image corresponding to the minimum signal are acquired according to the minimum signal.

According to the minimum signal and through the LUT, the driving voltage of the first image and the driving voltage for the second image are acquired and are respectively denoted as the third driving voltage $P'_{TH}$ and the fourth driving voltage $P'_{TL}$. S230 can be carried out after the minimum signal is acquired.

In step S240, the backlight brightness compensation signal is calculated according to the first driving voltage, the second driving voltage, the third driving voltage, the fourth driving voltage and the reference backlight brightness signal.

In the present embodiment, the backlight brightness compensation signals are grouped signals. Each backlight brightness compensation signal group includes a backlight brightness compensation signal $L_L$ to perform backlight compensation for the first frame image of the next picture and a backlight brightness compensation signal $L_H$ to perform backlight compensation for the second frame image of the next picture.

Reference backlight brightness signal L is the backlight brightness signal whereby a backlight compensation is not performed to the backlight brightness. To calculate the backlight brightness compensation signal according to the first driving voltage $P_{TH}$, the second driving voltage $P_{TL}$, the third driving voltage $P'_{TH}$, the fourth driving voltage $P'_{TL}$ and the reference backlight brightness signal $L_L$ and $L_H$, the calculation formula is as follows:

$$L_L<L<L_H \quad (1);$$

$$P_{TH}\times L+P_{TL}\times L=P_{TH}\times L_L+P_{TL}\times L_H \quad (2);$$

$$P'_{TH}\times L+P'_{TL}\times L=P'_{TH}\times L_L+P'_{TL}\times L_H \quad (3);$$

The backlight brightness compensation signal $L_L$ is configured for backlight compensation for the backlight brightness of the first frame image of the next picture. The backlight brightness compensation signal $L_H$ is configured for backlight compensation for the backlight brightness of the second frame image of the next picture. To calculate the backlight brightness compensation signals $L_L$ and $L_H$, the conditions in the formulas (1), (2) and (3) shall be satisfied. Through the above formulas to calculate, several groups of backlight brightness compensation signals $L_L$ and $L_H$ that satisfy the requirement can be acquired. Therefore, corresponding subsidiary conditions can be introduced to determine a group therein as the most ideal compensation value. For example, the compensation signal can be determined by limiting the range of the difference value between the backlight brightness compensation signals $L_L$ and $L_H$. In the present embodiment, in the calculation process, it is also needed to determine whether the difference value between the first driving voltage $P_{TH}$ and the second driving voltage $P_{TL}$ is greater than the compensation critical value X, i.e. satisfying:

$$P_{TH}-P_{TL}>X \quad (4);$$

When the condition (4) is not satisfied, in other words, the signal voltage difference is no greater than the compensation critical value X, the backlight brightness compensation is not started, the backlight brightness of the LCD device is maintained at the reference backlight brightness L, so as to avoid a backlight compensation for the backlight brightness when the voltage signal difference is relatively small, the complexity of the driving process is reduced, such that the stability of the system is improved.

In step S130, a backlight brightness compensation for the next picture is performed according to the backlight brightness compensation signal.

According to the backlight compensation signals $L_L$ and $L_H$, a backlight compensation is performed to the backlight brightness. Particularly, the backlight brightness compensation signal $L_L$ is configured to lower the backlight brightness of the first frame image of the next picture, such that its brightness is under the reference backlight brightness. The backlight brightness compensation signal $L_H$ is configured to increase the backlight brightness of the second frame image of the next picture, such that its brightness is higher than the reference backlight brightness, thereby reducing the original blinking phenomenon resulted from the major frame brightness difference led by the high and low driving voltages, and may have an effect of a favorable viewing angle compensation, thereby providing the LCD device with a relatively low viewing angle color shift.

The above LCD device and the method for driving the same, by displaying each picture with two frame images, the driving voltages of corresponding sub-pixels in the two frame images are different; the backlight brightness compensation signal is determined in accordance with the driving voltages and reference backlight brightness signals of the two frame images, thereby compensating the backlight brightness of the next picture, such that the backlight brightness of the first frame image of the next picture is less than the reference backlight brightness and the backlight brightness of the second frame image is greater than the reference backlight brightness, thereby reducing the blinking due to the voltage switching difference of frame images and effectively improve the color shift problem of the LCD device due to a mismatching of refractive index in a large viewing angle. The above method for driving an LCD effects the viewing angle compensation with low color shift by a division of time domain. When the backlight brightness of the LCD device is permanently maintained at a fixed brightness, such that the difference between the high and low voltages of the driving voltage of the two frame images is major, the naked eyes can obviously notice the blinking of the high and low brightness signals, such that the visual difference is major and the user experience is poor. The above method for driving can well overcome such problem. Also, by employing the method for driving above, the pixels of the LCD device are no longer needed to be divided into primary and secondary sub-pixels, thereby greatly reducing the process complexity and remarkably increasing the penetration rate and resolution of the LCD panel and reducing the cost for backlight design.

Figure 3:
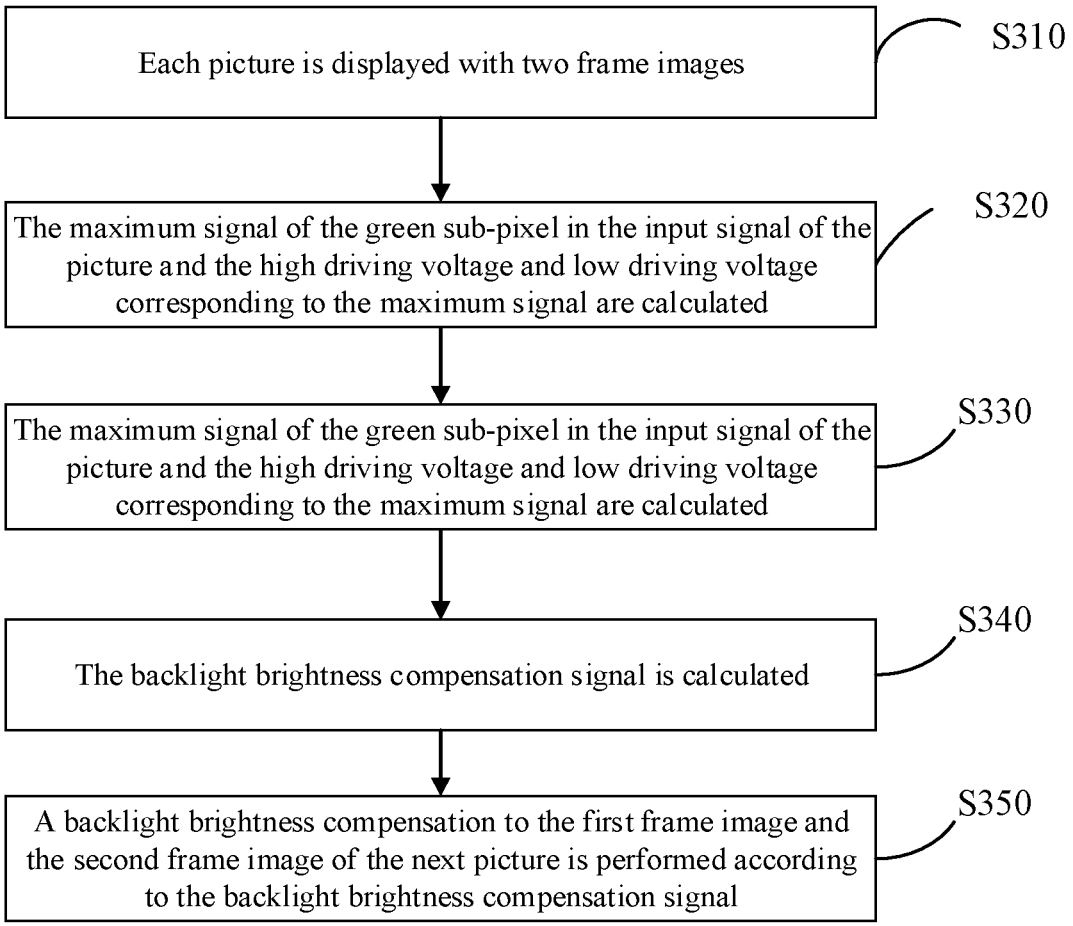
FIG. 3 is a flowchart of a method for driving an LCD device whose backlight is of white backlight source according to an embodiment.

FIG. 3 is a flowchart of a method for driving an LCD device whose backlight is of white backlight source. The method includes the following steps:

In step S310, each picture is displayed with two frame images.

A picture frame N is displayed through two frame images frame N_1 and frame N_2, i.e., the picture frame N is divided into frame image frame N_1 and frame N_2 in time sequence. The input signal of the picture frame N is an RGB signal.

In step S320, the maximum signal of the green sub-pixel in the input signal of the picture and the high driving voltage and low driving voltage corresponding to the maximum signal are calculated.

Calculate the maximum signal G of the green sub-pixel and, via the LUT, find and acquire the high driving voltage (i.e., the first driving voltage) $G_{TH}$ of the frame image N_1 and the low driving voltage (i.e., the second driving voltage) $G_{TH}$ of the frame image N_2.

In step S330, the maximum signal of the green sub-pixel in the input signal of the picture and the high driving voltage and low driving voltage corresponding to the maximum signal are calculated.

Calculate the minimum signal G' of the green sub-pixel and, via looking up in the LUT, acquire the high driving voltage (i.e. the third driving voltage) $G'_{TH}$ of the frame image N_1 and the low driving voltage (i.e., The fourth driving voltage) $G'_{TL}$ of the frame image N_2.

In step S340, the backlight brightness compensation signal is calculated.

The formula to calculate the backlight brightness compensation signal $L_L$ and $L_H$ is as follows.

$$L_L<L<L_H;$$

$$G_{TH}\times L+G_{TL}\times L=G_{TH}\times L_L G_{TL}\times L_H;$$

$$G'_{TH}\times L+G'_{TL}\times L=G'_{TH}\times L_L G'_{TL}\times L_H;$$

$$G_{TH}-G_{TL}>X.$$

In step S350, a backlight brightness compensation for the first frame image and the second frame image of the next picture is performed according to the backlight brightness compensation signal.

According to the calculated backlight brightness compensation signals $L_L$ and $L_H$, a backlight brightness compensation for the first frame image N+1_1 and the second frame image frame N+1_2 of the next picture frame N+1 is performed, such that the backlight brightness of the first frame image N+1_1 is less than the reference backlight brightness L, and the backlight brightness of the second frame image N+1_2 is greater than the reference backlight brightness L.

In the above driving process, the backlight brightness compensation signal is calculated solely via driving voltage for green sub-pixel and other parameters that are sensible to naked eyes, the data processing complexity can be reduced and the viewing angle color shift compensation requirement of the LCD device can be satisfied.

Figure 4:
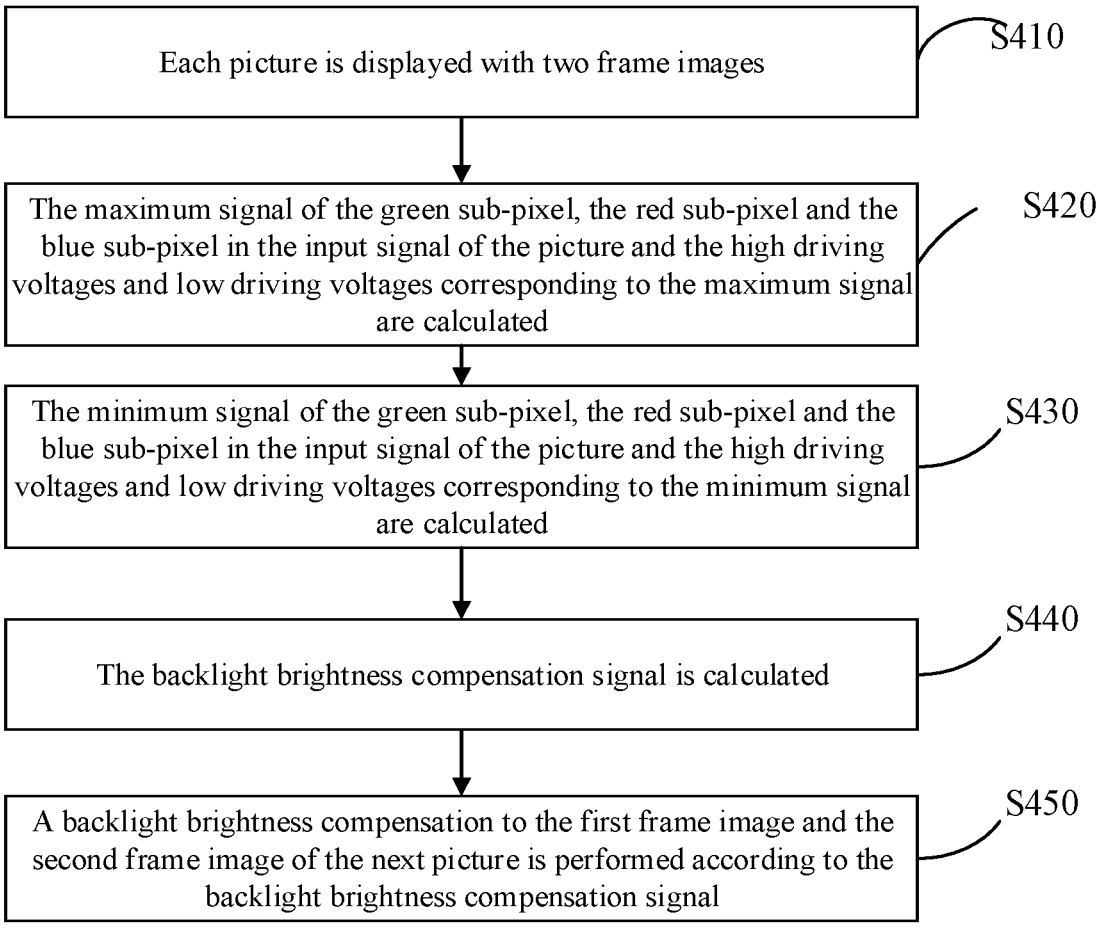
FIG. 4 is a flowchart of a method for driving an LCD device whose backlight is of RGB three color backlight source according to an embodiment.

FIG. 4 is a flowchart of the method driving the LCD device when the backlight is an RGB three color backlight source. The method includes the following steps:

In step S410, each picture is displayed with two frame images.

A picture frame N is displayed through two frame images frame N_1 and frame N_2, i.e. the picture frame N is divided into frame image frame N_1 and frame N_2 in time sequence. The input signal of the picture frame N is an RGB signal.

In step S420, the maximum signal of the green sub-pixel, the red sub-pixel and the blue sub-pixel in the input signal of the picture and the high driving voltages and low driving voltages corresponding to the maximum signal are calculated.

Calculate the maximum signal R, G, B of the Red sub-pixel, the green sub-pixel and the blue sub-pixel and, via looking up in the LUT, acquire the high driving voltage $R_{TH}$, $G_{TH}$, $B_{TH}$ of the frame image N_1 and the low driving voltage $R_{TL}$, $G_{TL}$ $B_{TL}$ of the frame image N_2.

In step S430, the minimum signal of the green sub-pixel, the red sub-pixel and the blue sub-pixel in the input signal of the picture and the high driving voltages and low driving voltages corresponding to the minimum signal are calculated.

Calculate the minimum signal R', G', B' of the red sub-pixel, green sub-pixel and blue sub-pixel and, via looking up in the LUT, acquire the high driving voltage $R'_{TH}$ $G'_{TH}$, $B'_{TH}$ of the frame image N_1 and the low driving voltage $R'_{TL}$, $G'_{TL}$, $B'_{TL}$ of the frame image N_2.

In step S440, the backlight brightness compensation signal is calculated.

The three groups of backlight brightness compensation signals $L_{RL}/L_{RH}$, $L_{GL}/L_{GH}$, $L_{BL}/L_{BH}$ corresponding to the R sub-pixel, the G sub-pixel and the B sub-pixel are decided according to the calculating of the R sub-pixel, the G sub-pixel and the B sub-pixel in picture frame N, therefore, the calculation formula of the backlight brightness compensation signal $L_{RL}/L_{RH}$ corresponding to the R sub-pixel is as follows:

$$L_{RL}<L<L_{RH};$$

$$R_{TH}\times L+R_{TL}\times L=R_{TH}\times L_{RL}R_{TL}\times L_{RH};$$

$$R'_{TH}\times L+R'_{TL}\times L=R'_{TH}\times L_{RL}+R'_{TL}\times L_{RH};$$

$$R_{TH}-R_{TL}>X.$$

The calculation formula of the backlight brightness compensation signal $L_{GL}/L_{GH}$ corresponding to the G sub-pixel is as follows.

$$L_{GL}<L<L_{GH};$$

$$G_{TH}\times L+G_{TL}\times L=G_{TH}\times L_{GL}+G_{TL}\times L_{GH};$$

$$G'_{TH}\times L+G'_{TL}\times L=G'_{TH}\times L_{GL}+G'_{TL}\times L_{GH};$$

$$G_{TH}-G_{TL}>X.$$

The calculation formula of the backlight brightness compensation signal $L_{BL}/L_{BH}$ corresponding to the B sub-pixel is as follows.

$L_{BL}<L<L_{BH}$;

$B_{TH}\times L+B_{TL}\times L=B_{TH}\times L_{BL}+B_{TL}\times L_{BH}$;

$B'_{TH}\times L+B'_{TL}\times L=B'_{TH}\times L_{BL}+B'_{TL}\times L_{BH}$;

$B_{TH}-B_{TL}>X$.

In step S450, a backlight brightness compensation for the first frame image and the second frame image of the next picture is performed according to the backlight brightness compensation signal.

According to the calculated backlight brightness compensation signals $L_{RL}/L_{RH}$, $L_{GL}/L_{GH}$, $L_{BL}/L_{BH}$ perform a backlight compensation for the backlight brightness of the corresponding sub-pixels in the first frame image N+1_1 and second frame image N+1_2 of the next picture frame N+1.

In the above driving process, the backlight brightness compensation signals are decided according to the calculating results of the corresponding color sub-pixels in the last picture and are hence provided with a high compensation accuracy to preferably reduce the viewing angle color shift of the LCD device.

Figure 5:
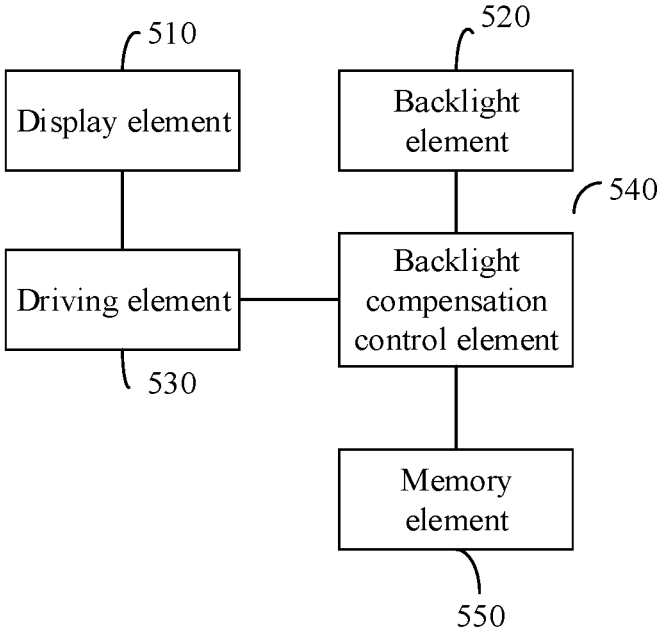
FIG. 5 is a block diagram of the structure of an LCD device according to an embodiment.

The present disclosure also provides an LCD as illustrated in FIG. 5. The liquid crystal device includes a display element 510, a backlight element 520, a driving element 530 and a backlight compensation control element 540.

The display element 510 can be an TN, an OCB, an VA, an TFT and an COA display panel, but not limited thereto. The display element 510 can also be a curved display panel.

The backlight element 520 is configured to provide backlight. The backlight element 520 may apply straight down or side backlight. The backlight element may adopt a white light, an RGB three color light source, an WRGB four color light source or an RGBY four color light source, but not limited thereto.

The driving element 530 is connected to display element 510. The driving element 530 is configured to display each picture with two frame images. The two frame images are respectively a first image and a second image. The driving voltage for each sub-pixel in the first frame image is greater than the driving voltage for a corresponding sub-pixel in the second frame image. The driving voltage of the driving element 530 driving each sub-pixel can be acquired by looking up in the LUT. In particular, in the LCD device, the LUT will be pre-stored in the hardware frame buffer (i.e. the memory element 550) beforehand. The LUT is a correspondence table on the picture input signals and the driving voltages for each sub-pixel in the first frame image and the second frame image which are corresponding to the input signals.

Figure 6:
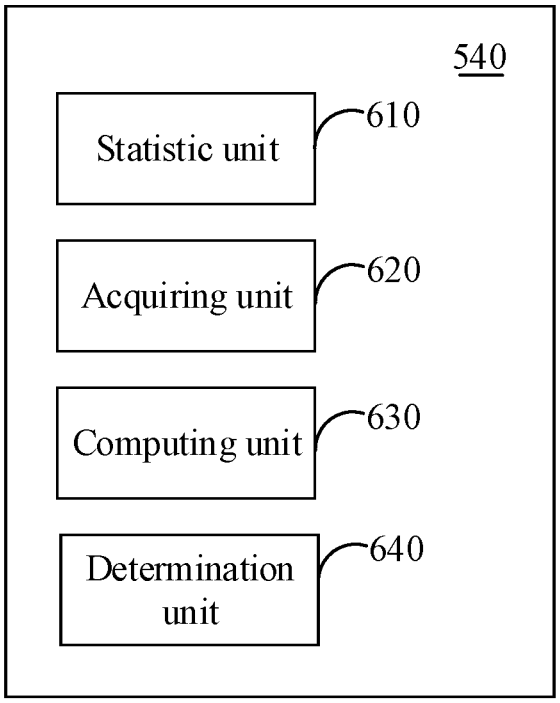
FIG. 6 is a block diagram of the structure of a backlight brightness compensation element according to an embodiment.

The backlight compensation control element 540 is connected to the driving element 530 and the backlight element 520. The backlight compensation control element 540 is configured to determine the backlight brightness compensation signal according to the driving voltages of the first frame image and the second frame image and, according to the backlight brightness compensation signal, to compensate the backlight brightness of a next picture, such that the backlight brightness of the first frame image of the next picture is less than a reference backlight brightness and the backlight brightness of the second frame image is greater than the reference backlight brightness;

The backlight compensation control element 540 includes a memory and at least one processor. The memory has pre-stored computer executable instructions that can be executed by the at least one processor. When the computer executable instruction is to be executed by the at least one processor, the at least one processor will execute the steps in the following units, as illustrated in FIG. 6. The statistic unit 610 is configured to calculate the maximum signal and the minimum signal of the target color sub-pixel in the input signal of each picture. The acquiring unit 620, is configured to acquire the driving voltage of the first frame image and the driving voltage of the second frame image corresponding to the maximum signal according to the maximum signal, and to designate the driving voltage of the first frame image as a first driving voltage and the driving voltage of the second frame image as a second driving voltage. The acquiring unit 620 is further configured to acquire the driving voltage of the first frame image and the driving voltage of the second frame image corresponding to the minimum signal according to the minimum signal, and to designate the driving voltage of the first frame image as a third driving voltage and the driving voltage of the second frame image as a fourth driving voltage. In one embodiment, the LCD device also includes a memory element 550 as shown in FIG. 5. The memory element 550 is configured to pre-store the LUT. The LUT is a correspondence table on the picture input signals and the driving voltages for each sub-pixel in the first frame image and the second frame image which are corresponding to the input signals. Therefore, the acquiring unit 620 is configured to acquire the corresponding driving voltage via the LUT. In the present embodiment, the LUT the acquiring unit 620 configured to acquire the driving voltage and the LUT the driving element 530 configured to acquire the driving voltages for the first frame image and the second frame image are the same LUT. The calculation unit 630 is configured to calculate the backlight brightness compensation signal according to the first driving voltage, the second driving voltage, the third driving voltage, the fourth driving voltage and the reference backlight brightness signal, the formula is as follows:

$L_L<L<L_H$;

$P_{TH}\times L+P_{TL}\times L=P_{TH}\times L_L+P_{TL}\times L_H$;

$P'_{TH}\times L+P'_{TL}\times L=P'_{TH}\times L_L+P'_{TL}\times L_H$;

$L_L$ is the backlight brightness compensation signal to perform backlight compensation for the first frame image of the next picture; $L_H$ is the backlight brightness compensation signal to perform backlight compensation for the second frame image of the next picture; $P_{TH}$ is the first driving voltage; $P_{TL}$ is the second driving voltage; $P'_{TH}$ is the third driving voltage; $P'_{TL}$ is the fourth driving voltage; L is the reference backlight brightness signal, P is a target color sub-pixel.

In the present embodiment, the processor in the backlight compensation control element 540 also executes the steps in the determination unit 640. The determination unit 640 is configured to determine whether the difference value between the first driving voltage and the second driving voltage is greater than the compensation critical value. The backlight compensation control element 540 will perform a backlight compensation for the next picture according to the backlight brightness compensation signal calculated according to the calculating in the case the determination unit 640 has determined that the difference value between the first driving voltage and the second driving voltage is greater than the compensation critical value.

The above LCD device, by displaying each picture with two frame images, the driving voltages of corresponding sub-pixels in the two frame images are different; the backlight brightness compensation signal is determined in accordance with the driving voltages and reference backlight brightness signals of the two frame images, thereby compensating the backlight brightness of the next picture, such that the backlight brightness of the first frame image of the next picture is less than the reference backlight brightness and the backlight brightness of the second frame image is greater than the reference backlight brightness, thereby reducing the blinking due to the voltage switching difference of frame images and effectively improve the color shift problem of the LCD device due to a mismatching of refractive index in a large viewing angle.

The different technical features of the above embodiments can have various combinations which are not described for the purpose of brevity. Nevertheless, to the extent the combining of the different technical features does not conflict with each other, all such combinations must be regarded as within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A method for driving a liquid crystal display (LCD) device, comprising:

displaying each picture with two frame images, wherein the two frame images comprise a first frame image and a second frame image; a driving voltage for each sub-pixel in the first frame image is greater than a driving voltage for a corresponding sub-pixel in the second frame image;

determining a backlight brightness compensation signal according to the driving voltages of the first frame image and the second frame image; and performing a backlight brightness compensation for a next picture according to the backlight brightness compensation signal, such that a backlight brightness of the first frame image of the next picture is less than a reference backlight brightness, and a second backlight brightness of the second frame image of the next picture is greater than the reference backlight brightness, wherein the driving voltages for a sub-pixel in the first frame image and the second frame image are acquired by looking up in a Look-up Table (LUT) in accordance with input signals, and the LUT is a correspondence table between the input signals and the driving voltages for the sub-pixel in the first frame image and the second frame image, and the first frame image and the second frame image are corresponding to the input signals.

2. The method according to claim 1, further comprising a step of pre-storing the LUT.

3. The method according to claim 1, wherein the step of determining the backlight brightness compensation signal according to the driving voltages of the first frame image and the second frame image comprises:

calculating a maximum signal and a minimum signal of a target color sub-pixel in the input signal of each picture;

acquiring a driving voltage of the first frame image and a driving voltage of the second frame image corresponding to the maximum signal according to the maximum signal, and designating the driving voltage of the first frame image as a first driving voltage and designating the driving voltage of the second frame image as a second driving voltage;

acquiring a driving voltage of the first frame image and a driving voltage of the second frame image corresponding to the minimum signal according to the minimum signal, and designating the driving voltage of the first frame image as a third driving voltage and designating the driving voltage of the second frame image as a fourth driving voltage; and calculating the backlight brightness compensation signal according to the first driving voltage, the second driving voltage, the third driving voltage, the fourth driving voltage and the reference backlight brightness signal.

4. The method according to claim 3, wherein in the step of calculating of the backlight brightness compensation signal according to the first driving voltage, the second driving voltage, the third driving voltage, the fourth driving voltage and the reference backlight brightness signal, a calculation formula is as follows:

$$L_L<L<L_H;$$

$$P_{TH}\times L+P_{TL}\times L=P_{TH}\times L_L+P_{TL}\times L_H;$$

$$P'_{TH}\times L+P'_{TL}\times L=P'_{TH}\times L_L+P'_{TL}\times L_H;$$

wherein $L_L$ is the backlight brightness compensation signal to perform backlight compensation for the first frame image of the next picture; $L_H$ is the backlight brightness compensation signal to perform backlight compensation for the second frame image of the next picture; $P_{TH}$ is the first driving voltage; $P_{TL}$ is the second driving voltage; $P'_{TH}$ is the third driving voltage; $P'_{TL}$, is the fourth driving voltage; L is the reference backlight brightness signal, P is a target color sub-pixel.

5. The method according to claim 3, wherein the backlight brightness compensation signals are grouped signals, each backlight brightness compensation signal group comprises a backlight brightness compensation signal to perform a backlight compensation for the first frame image of the next picture and a backlight brightness compensation signal to perform backlight compensation for the second frame image of the next picture;

wherein when the backlight of the LCD is a white backlight source, the target color sub-pixel is a green sub-pixel, the backlight brightness compensation signal is a group to perform backlight compensation for the brightness of the white backlight source.

6. The method according to claim 3, wherein the backlight brightness compensation signals are grouped, each backlight brightness compensation signal group comprises a backlight brightness compensation signal to perform backlight compensation for the first frame image of the next picture and a backlight brightness compensation signal to perform backlight compensation for the second frame image of the next picture;

wherein when the backlight of the LCD is an RGB three color backlight source, the target color sub-pixel comprises a green sub-pixel, a red sub-pixel and a blue sub-pixel; the backlight brightness compensation signals comprise three groups of backlight brightness compensation signals that are respectively corresponding to the red sub-pixel, the green sub-pixel and the blue sub-pixel.

7. The method according to claim 3, wherein the backlight brightness compensation for the next picture according to the backlight brightness compensation signal is performed when a difference between the first driving voltage and the second driving voltage is greater than a compensation critical value.

8. A liquid crystal display (LCD) device, comprising: a display element; a backlight element to provide backlight for the display element;

a driving element connected to the display element and to display each picture with two frame images; wherein the two frame images include a first frame image and a second frame image; a driving voltage for each sub-pixel in the first frame image is greater than a driving voltage for a corresponding sub-pixel in the second frame image;

a backlight compensation control element connected to the backlight element and to determine a backlight brightness compensation signal according to the driving voltages of the first frame image and the second frame image and compensate a backlight brightness of a next picture according to the backlight brightness compensation signal, such that a backlight brightness of the first frame image of the next picture is less than a reference backlight brightness and a backlight brightness of the second frame image of the next picture is greater than the reference backlight brightness, wherein the driving element is configured to acquire the driving voltages for a sub-pixel of the first frame image and the second frame image according to the input signals and via looking up in the LUT; wherein the LUT is a correspondence table on input signals and the driving voltages for the sub-pixel in the first frame image and the second frame image, and the first frame image and the second frame image are corresponding to the input signals.

9. The LCD device according to claim 8, wherein further comprises a memory element configured to pre-store the LUT.

10. The LCD device according to claim 8, wherein the backlight compensation control element comprises at least one memory storing computer-readable instructions; and at least one processor that executes the instructions to provide:

a statistic unit to calculate a maximum signal and a minimum signal of a target color sub-pixel in the input signal of each picture;

an acquiring unit to acquire a driving voltage of the first frame image and a driving voltage of the second frame image corresponding to the maximum signal according to the maximum signal, and to designate the driving voltage of the first frame image as a first driving voltage and the driving voltage of the second frame image as a second driving voltage;

wherein the acquiring unit is further configured to acquire a driving voltage of the first frame image and a driving voltage of the second frame image corresponding to the minimum signal according to the minimum signal, and designating the driving voltage of the first frame image as a third driving voltage and designating the driving voltage of the second frame image as a fourth driving voltage; and a computing unit to calculate the backlight brightness compensation signal according to the first driving voltage, the second driving voltage, the third driving voltage, the fourth driving voltage and the reference backlight brightness signal.

11. The LCD device according to claim 10, wherein in the step of calculating the backlight brightness compensation signal according to the first driving voltage, the second driving voltage, the third driving voltage, the fourth driving voltage and the reference backlight brightness signal, the calculation formula is as follows:

$$L_L<L<L_H;$$

$$P_{TH}\times L+P_{TL}\times L=P_{TH}\times L_L+P_{TL}\times L_H;$$

$$P'_{TH}\times L+P'_{TL}\times L=P'_{TH}\times L_L+P'_{TL}\times L_H;$$

wherein $L_L$ is the backlight brightness compensation signal to perform a backlight compensation for the first frame image of the next picture; $L_H$ is the backlight brightness compensation signal to perform a backlight compensation for the second frame image of the next picture; $P_{TH}$ is the first driving voltage; $P_{TL}$ is the second driving voltage; $P'_{TH}$ is the third driving voltage; $P'_{TL}$ is the fourth driving voltage; L is the reference backlight brightness signal, P is a target color sub-pixel.

12. The LCD device according to claim 10, wherein the backlight brightness compensation signals are grouped signals; each backlight brightness compensation signal group comprises the backlight brightness compensation signal to perform the backlight compensation for the first frame image of the next picture and the backlight brightness compensation signal to perform the backlight compensation for the second frame image of the next picture;

wherein the backlight element adopts white backlight source; the target color sub-pixel is a green sub-pixel; the backlight brightness compensation signal is a group to perform the backlight compensation for the brightness of the white backlight source.

13. The LCD device according to claim 10, wherein the backlight brightness compensation signals are grouped signals; each backlight brightness compensation signal group comprises the backlight brightness compensation signal to perform the backlight compensation for the first frame image of the next picture and the backlight brightness compensation signal to the perform backlight compensation for the second frame image of the next picture;

wherein the backlight element adopts a RGB three color backlight source; the target color sub-pixels comprise a red sub-pixel, a green sub-pixel and a blue sub-pixel; wherein the backlight brightness compensation signals comprise three groups of backlight brightness compensation signals that are respectively corresponding to the red sub-pixel, the green sub-pixel and the blue sub-pixel.

14. The LCD device according to claim 10, wherein the at least one processor further executes the steps in the following units:

determination unit configured to determine whether a difference between the first driving voltage and the second driving voltage is greater than a compensation critical value;

wherein the backlight compensation for the next picture is performed when the difference value between the first driving voltage and the second driving voltage is determined by the determination unit to be greater than the compensation critical value.

15. The LCD device according to claim 8, wherein the display element is a Twisted Nematic (TN) display panel, an Optically Compensated Bend (OCB) display panel, a Vertical Alignment (VA) or a Color Filter on Array (COA) display panel.

16. The LCD device of claim 8, wherein the display element is a flat display panel or a curved display panel.

17. A liquid crystal display (LCD) device, comprising:

a display element;

a backlight element to provide backlight for the display element;

a driving element connected to the display element and to display each picture with two frame images; wherein the two frame images include a first frame image and a second frame image; a driving voltage for each sub-pixel in the first frame image is greater than a driving voltage for a corresponding sub-pixel in the second frame image;

a backlight compensation control element connected to the backlight element and to determine a backlight brightness compensation signal according to the driving voltages of the first frame image and the second frame image and, according to the backlight brightness compensation signal, compensate a backlight brightness of a next picture, such that a backlight brightness of the first frame image of the next picture is less than a reference backlight brightness and a backlight brightness of the second frame image is greater than the reference backlight brightness;

wherein the backlight compensation control element comprises at least one memory storing computer-readable instructions; and at least one processor that executes the instructions to provide:

a statistic unit to calculate a maximum signal and a minimum signal of the target color sub-pixel in an input signal of each picture;

an acquiring unit to acquire a driving voltage of the first frame image and a driving voltage of the second frame image corresponding to the maximum signal according to the maximum signal, and designating the driving voltage of the first frame image as a first driving voltage and designating the driving voltage of the second frame image as a second driving voltage; wherein the acquiring unit is further configured to acquire a driving voltage of the first frame image and a driving voltage of the second frame image corresponding to the minimum signal according to the minimum signal, and to designating the driving voltage of the first frame image as a third driving voltage and the driving voltage of the second frame image as a fourth driving voltage; and a computing unit to calculate the backlight brightness compensation signal according to the first driving voltage, the second driving voltage, the third driving voltage, the fourth driving voltage and a reference backlight brightness signal;

wherein in calculating the backlight brightness compensation signal according to the first driving voltage, the second driving voltage, the third driving voltage, the fourth driving voltage and the reference backlight brightness signal, a calculation formula is as follows:

$$L_L<L<L_H;$$

$$P_{TH}\times L+P_{TL}\times L=P_{TH}\times L_L+P_{TL}\times L_H;$$

$$P'_{TH}\times L+P'_{TL}\times L=P'_{TH}\times L_L+P'_{TL}\times L_H;$$

wherein $L_L$ is the backlight brightness compensation signal to perform a backlight compensation for the first frame image of the next picture; $L_H$ is the backlight brightness compensation signal to perform a backlight compensation for the second frame image of the next picture; $P_{TH}$ is the first driving voltage; $P_{TL}$ is the second driving voltage; $P'_{TH}$ is the third driving voltage; $P'_{TL}$ is the fourth driving voltage; L is the reference backlight brightness signal, P is a target color sub-pixel.

18. The LCD device according to claim 17, wherein the at least one processor further executes the instructions to provide:

a determination unit configured to determine whether a difference between the first driving voltage and the second driving voltage is greater than a compensation critical value;

wherein the backlight compensation for the next picture is performed by the backlight compensation control element when the difference value between the first driving voltage and the second driving voltage is greater than the compensation critical value.

* * * * *